United States Patent [19]

Vaudrey

[11] 4,217,810

[45] Aug. 19, 1980

[54] REGULATION SYSTEM FOR STEAM TURBINES

[75] Inventor: Pierre Vaudrey, Belfort, France

[73] Assignee: Alsthom-Atlantique, Paris, France

[21] Appl. No.: 948,613

[22] Filed: Oct. 4, 1978

[30] Foreign Application Priority Data

Oct. 6, 1977 [FR] France ..... 77 30111

[51] Int. Cl.[3] ..... F15B 9/03; F15B 9/09; F15B 13/044

[52] U.S. Cl. ..... 91/363 A; 91/451; 91/459; 91/461

[58] Field of Search ..... 91/363 A, 451

[56] References Cited

U.S. PATENT DOCUMENTS 3,826,174 7/1974 Platt ..... 91/363 A

FOREIGN PATENT DOCUMENTS 1161029 10/1958 France ..... 91/451

*Primary Examiner*—Paul E. Maslousky

*Attorney, Agent, or Firm*—Sughrue, Rothwell, Mion, Zinn and Macpeak

[57] ABSTRACT

A regulation system for steam turbines which includes a servomotor controlled by a servovalve (1) and two safety valves (31, 31') controlled by two electrically-operated valves (19, 19'). When the control inlet (7) of the servomotor is connected to the drain pipe (6) by at least one of the safety valves, the high-pressure fluid supply to the servovalve is simultaneously cut and the high-pressure fluid source is thereby prevented from discharging directly into the drain pipe. This enables high-pressure fluid sources having a low discharge rate to be used.

1 Claim, 3 Drawing Figures

REGULATION SYSTEM FOR STEAM TURBINES

FIELD OF THE INVENTION

The present invention relates to a regulation system for a steam turbine.

SUMMARY OF THE INVENTION

The system includes:

a servomotor which comprises firstly a piston which slides in a chamber one of whose ends is connected to a drain pipe and whose other end is connected to a fluid inlet which controls the piston and secondly a spring which tends to move the piston away from the end connected to the drain pipe, the position of the piston controlling the steam inlet means, said means being fully open when the piston is near the end connected to the drain pipe and being fully closed when the piston is moved as far as possible from said end; a regulation circuit which compares a signal which is a function of a steam admission instruction and a signal from the servomotor which is a function of the position of the piston and which delivers an error signal;

a servovalve comprising firstly an inlet connected to a pipe which is itself connected to a high-pressure fluid source, a control outlet connected to the control input of the servomotor and an output connected to the drain pipe, and secondly a slide valve whose position is controlled by a torque motor which receives the servomotor error signal, said slide valve coupling the control outlet with the drain pipe when the error signal corresponds to excessive steam admission, or coupling the control outlet with the control inlet when it corresponds to insufficient steam admission;

two electrically operated valves which each receive a signal which operates them in the case of accident, each electrically operated valve having an inlet connected to the high-pressure fluid source, a first outlet connected to the drain pipe and a second outlet connected to a safety valve, the second outlet communicating with the input when the electrically operated valve is operated and with the first outlet when the electrically operated valve is released; and each safety valve comprising firstly an outlet connected to the drain pipe, and inlet connected to the second outlet of the associated electrically operated valve and a second inlet connected to the control inlet of the servomotor and secondly a moving piston which can assume two positions: a first position when high-pressure fluid is applied to the inlet and a second position when the inlet is connected to the drain pipe, the second inlet being connected to the drain pipe when the piston is in the second position and being isolated from the drain pipe when the piston is in the first position.

To test the proper operation of the servomotor steam admission assembly, one of the electrically operated valves is rapidly put out of service; this lifts the piston of the associated safety valve and the control inlet of the servomotor is connected to the drain pipe. The steam admission instruction for opening the steam admission units is not in equilibrium with respect to the position of the servomotor, so that the high-pressure fluid which comes from the source is applied via the servovalve to the control inlet of the servomotor which has just been connected to the drain pipe. In order to avoid connecting the high-pressure fluid source to the drain pipe, as this would unbalance all the other regulation circuits, the regulation system according to the invention is characterized in that each electrically operated valve has a third outlet which is connected to the drain pipe when the electrically operated valve is operated and which is connected to the inlet when the electrically operated valve is released and in that the pipe connected to the inlet of the servovalve is connected to the high-pressure fluid source via an isolation valve which comprises firstly a first inlet connected to the high-pressure fluid source and an outlet connected to said pipe as well as two control inlets which are connected to the third inlets of both of the electrically operated valves and which, when at least one of the electrically operated valves receives high-pressure fluid, help a spring to push a piston into a blocking position for blocking communication between the first inlet and the outlet, said piston being returned to the other position by the high-pressure fluid applied by the source to its first inlet, when the two control inlets are connected to the drain pipe, which connects said first inlet to the outlet of said isolation valve.

In the system in accordance with the invention, when an electrically operated valve is released to check for proper operation, the piston of the isolation valve is pushed by a spring and the high-pressure fluid which comes from the third outlet of the electrically operated valve; this cuts the high-pressure supply of the servovalve and thereby prevents the high-pressure fluid source from being connected to the drain pipe via the servovalve. It is therefore possible to use high-pressure fluid sources having low discharge rate in the regulation system in accordance with the invention.

BRIEF DESCRIPTION OF THE DRAWINGS

The invention will be better understood from the following description of an embodiment, with reference to the accompanying drawings.

Figure 1:
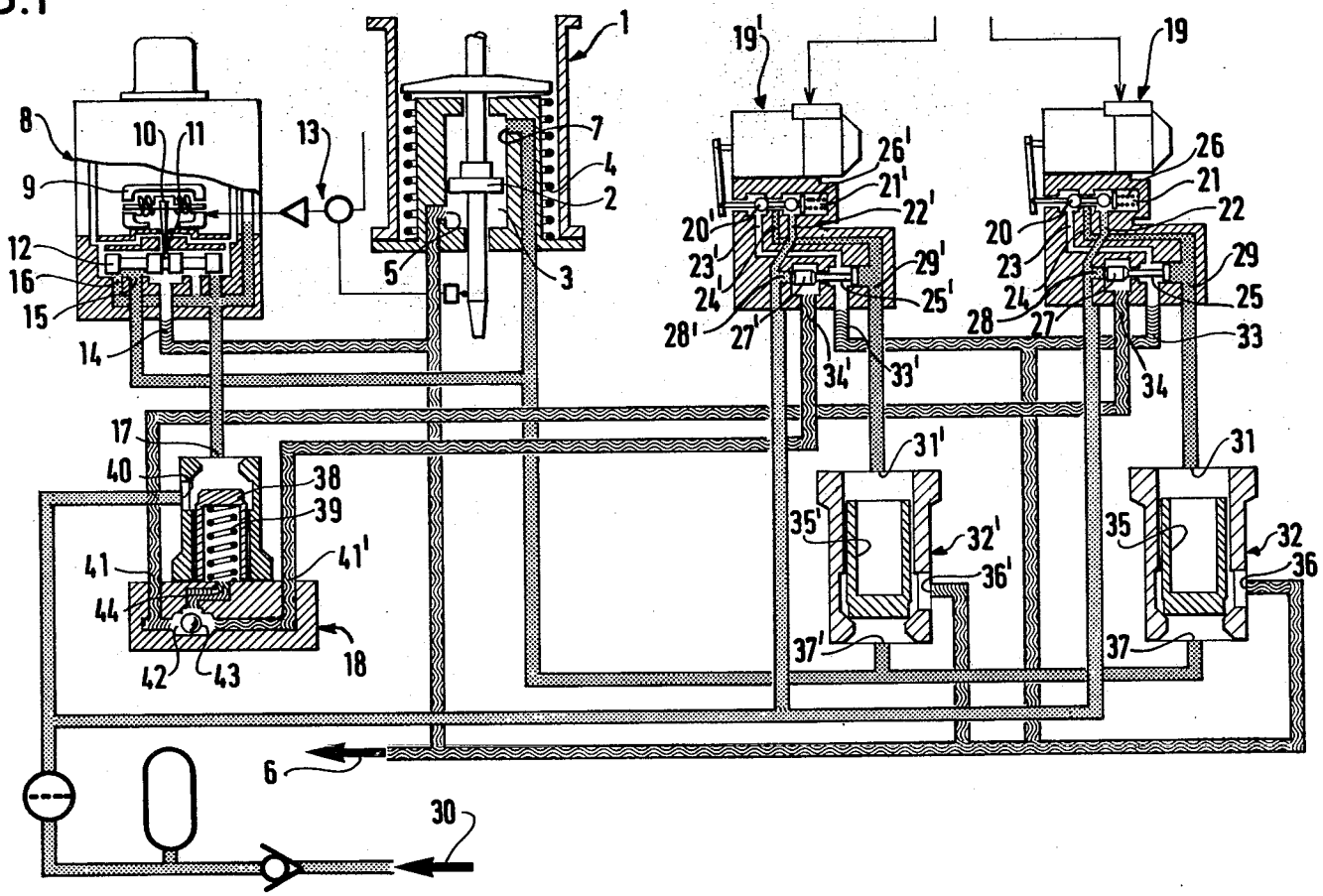
FIG. 1 is a schematic diagram which illustrates a regulation system in accordance with the invention with the safety devices closed.

The regulation system such as illustrated in FIG. 1 includes a servomotor 1 having a piston 2 movable between a low position and a high position in a chamber 3. The piston 2 is returned to the high position by a spring 4. The high position closes the steam admission units (not shown) for admitting steam into a turbine and the low position opens these units to their maximum setting. A fluid pipe 5 connected to a drain pipe 6 communicates with the lower end of the chamber 3. A control fluid inlet pipe or inlet 7 is connected to the upper end of the chamber 3.

The regulation system further includes a servovalve 8 which includes a DC torque motor 9 with two hydraulic amplifier stages. The first stage is formed by an armature 10 placed between two nozzles 11; one end of the armature follows the movement of a control slide valve 12 and the other follows that of the torque motor. The movement of the armature between the nozzles modifies the flow of the fluid from the nozzles; the differential pressure thus generated is applied to both ends of the slide valve 12 and causes it to move. A follow-up spring (not shown) holds the assembly in a middle position when the torque motor is not energized. The travel of the slide valve is directly proportional to the current which flows through the torque motor. The current is supplied by a regulation circuit 13 which provides a signal proportional to the difference between a signal which is a function of the steam admission instruction of the inlet circuits and a signal which is a function of the position of the piston 2.

The servovalve has an outlet 14 connected to the drain pipe 6, an outlet 15 connected to the control fluid inlet pipe 7 and an inlet 16 connected to the outlet 17 of an isolation valve 18.

The system also includes two electrically-operated valves 19 and 19'. The electrically-operated valve 19 includes a slide valve 20 which moves in a chamber 21. A pipe 22 connected to the high-pressure fluid source 30 communicates with the right-hand side of the chamber 21; a pipe 23 connected to the drain pipe 6 communicates with the left-hand side of the chamber 21; a pipe 24 connects the intermediate part of the chamber 21 with the right-hand end of a chamber 25. When the electrically-operated valve 19 is released, the slide valve 20 is pushed to the left by a spring 26; this makes the pipe 24 communicate with the drain pipe. When the electrically-operated valve is operated, the slide valve 20 is pushed back to the right; this makes the pipe 24 communicate with the pipe 22 connected to the high-pressure fluid source.

The chamber 25 has a slide valve 27; the left-hand end of the chamber 25 has an inlet 28 connected to the high-pressure source. The right-hand end of the chamber 25 has an outlet 29 connected to the inlet 31 of a safety valve 32.

The chamber 25 has an outlet 33 connected to the drain pipe 6 and an outlet 34 for controlling an isolation valve 18.

When the slide valve 20 is pushed towards the right (electrically-operated valve 19 operated) as shown in FIG. 1, the pipe 24 communicates with the pipe 22 connected to the high-pressure source. The outlet 29 is therefore connected to the high-pressure source. The right-hand end of the slide valve 27 has a greater area than its left-hand end, so that when both these ends are subjected to the pressure of the high-pressure fluid, the slide valve 27 is pushed to the left and a control outlet 34 communicates with the drain pipe 6.

When the electrically-operated valve 19 is released (FIG. 2) the slide valve 20 is pushed to the left by the spring 26; a pipe 24 is connected to the drain pipe 6 so that the chamber 25 is also connected to the drain pipe. The high-pressure fluid applied to the left-hand end of the slide valve 27 pushes the slide valve to the right and an outlet 34 is connected to the high-pressure source.

A safety valve 32 has a moving piston 35, an outlet 36 connected to the drain pipe and an inlet 37 connected to the control fluid inlet pipe 7 of the servomotor.

When the high-pressure fluid is applied to the inlet 31 (FIG. 1) of the valve 32, the piston 35 is pushed onto its seat by the fluid and the inlet 37 is solated from the drain pipe 6. In contrast, when the inlet 31 is connected to the drain pipe (FIG. 2), the piston is lifted off its seat by the fluid pressure exerted under the valve 35 and generated by the closing action of the spring 4 of the servomotor and the inlet 37 is connected to the drain pipe.

The electrically-operated valve 19' identical to the valve 19 and its chamber 25' is connected to the inlet 31' of a safety valve 32' whose control inlet 37' is connected, like the inlet 37 of the valve 32, to the control fluid inlet pipe 7 of the servomotor and whose outlet 36' is connected, like the inlet 36, to the drain pipe.

The electrically-operated valve 19' has an outlet 34' which controls the isolation valve 18.

The isolaton valve 18 includes a piston 38 applied on its seat by a spring 39; it also includes an inlet 40 connected to the high-pressure fluid source as well as two control inlets 41, 41' connected to the outlets 34, 34' of the electrically-operated valves 19, 19'. The two inlets 41 and 41' communicate with a small chamber 42 in which is placed a moving ball 43. A pipe 44 connects the chamber 42 to the hollow portion of the piston 38.

The regulation system in accordance with the invention operates as follows:

During normal operation (FIG. 1), the electrically-operated valves 19 and 19' are operated so that the high-pressure fluid is applied to the inlets 31 and 31' of the valves 32 and 32' and so that the valve pistons are on their seats; the inlets 37 and 37' are then isolated from the outlets 36 and 36' which are connected to the drain pipe 6; Further, the outlets 34 and 34' of the electrically-operated valves 19 and 19' are connected to the drain pipe 6, so that a pipe 44 of the isolation valve is connected to the drain pipe 6.

The high-pressure fluid is applied to the inlet 40 of the valve 18 and since the pipe 44 is connected to the drain pipe, the high-pressure fluid pushes the piston 38 downwards, moving it off its seat. Hence, the inlet 40 communicates with the outlet 17 of the valve 18. The outlet 17 is therefore connected to the high-pressure fluid source so that the high-pressure fluid is applied to the inlet 16 of the servovalve 8.

When the steam admission units are not open wide enough, the torque motor 9 receives a current which moves the slide valve 12 to the left and brings the inlet 16 and the outlet 15 of the servovalve 8 into communication, so that the high-pressure fluid is applied to the control fluid inlet pipe 7 of the servomotor 1. The piston 2 moves towards the end of the chamber 3 near to the outlet 5 which is connected to the drain pipe.

When the admission units are sufficiently wide open, the current supplied by the regulation circuit 13 is cancelled and the slide valve 12 which is not attracted by the torque motor 9 assumes its equilibrium position and isolates the inlet 16 from the outlet 15.

When the admission units are too wide open, the torque motor receives a current which moves the slide valve 12 to the right and makes the outlet 15 of the servovalve communicate with the drain pipe, so that the control fluid inlet pipe 7 of the servomotor is connected to the drain pipe. The spring 4 moves the piston 2 of the servomotor away from the end of the chamber near to the outlet 5, thus closing the admission units. When the admission units are opened to the extent required, the current supplied by the regulation circuit is cancelled out and the slide valve 12 which is no longer urged by the torque motor 9 returns to its rest position in which the outlet 15 is isolated from the drain pipe, as is the inlet 16. The piston 2 of the servomotor 1 then stops in the position reached which corresponds to the extent to which it is required that the admission units should be opened.

Figure 2:
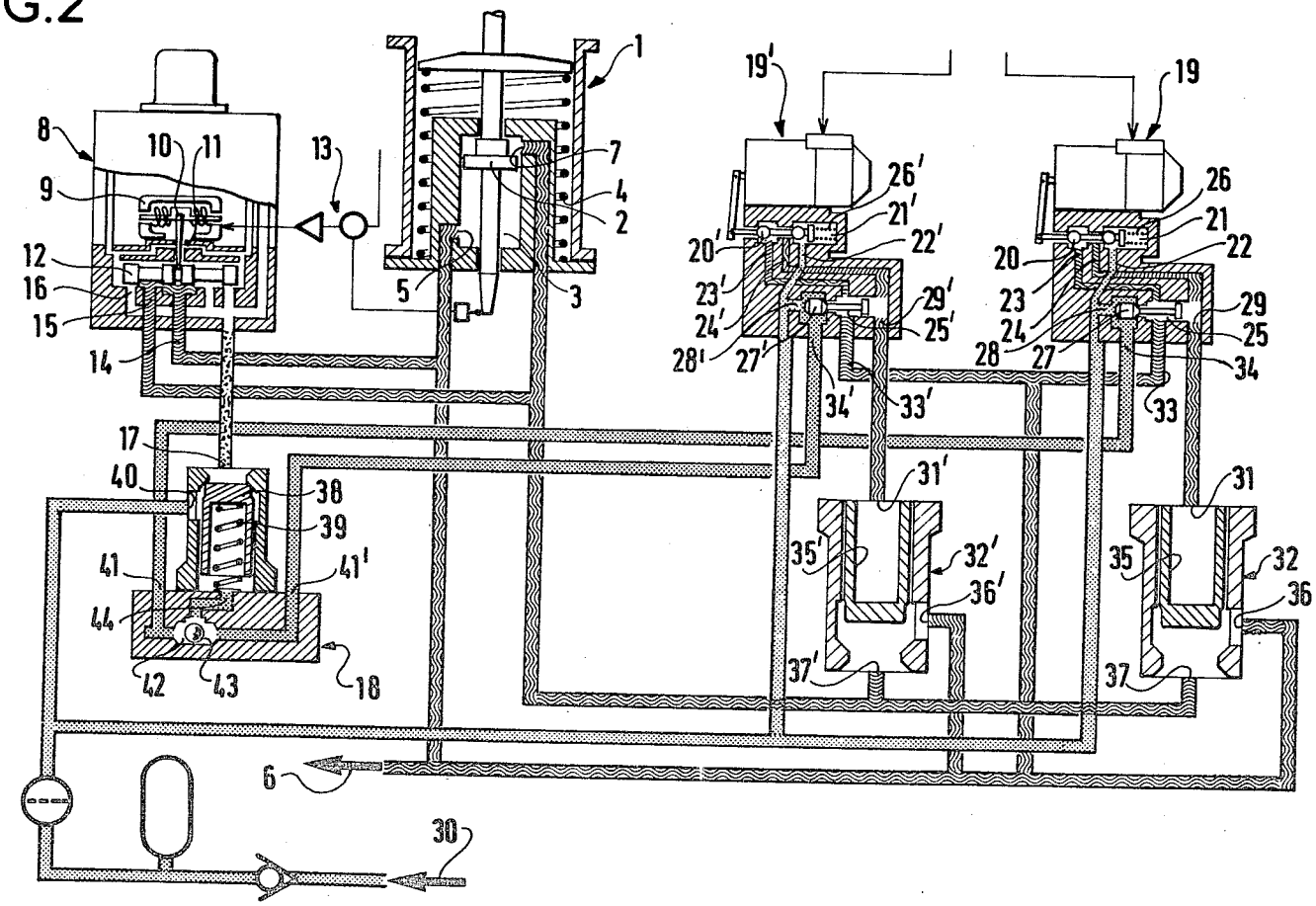
FIG. 2 is a schematic diagram which illustrates a regulation system in accordance with the invention with the safety devices open.

FIG. 2 shows the operation of the regulation system when the safety devices are released.

The electrically-operated valves 19 and 19' are released when an accident occurs. Immediately, the inlets 31 and 31' of the valves 32 and 32' are connected to the drain pipe, the pistons of these valves are pushed upwards and connect the inlets 37 and 37' to the drain pipe. The control fluid inlet pipe 7 of the servomotor 1 is connected to the drain pipe so that the spring 4 pushes the piston 2 and the steam admission units are completely closed.

It will be observed that the outlets 34 and 34' of the electrically-operated valves 19 and 19' are then connected to the high-pressure source. The pipe 44 is therefore connected to the high-pressure source. The piston 38 of the valve 18 is subjected to two opposing forces, one coming from the high-pressure fluid applied to the inlet 40, the other also coming from the high-pressure fluid in the pipe 44. These two forces cancel each other so that the piston 38 is pushed onto its seat by the spring 39 and the outlet 17 of the valve 18 is thereby isolated from the inlet 40. The outlet 17 is therefore isolated from the high-pressure fluid.

Since the servomotor is closed despite the applied steam admission instruction, a current energizes the torque motor 9 which moves the slide valve 12 to the left, making the inlet 16 communicate with the outlet of the servovalve.

Therefore the control fluid inlet pipe 7 of the servomotor is connected to the outlet 17 of the valve 18. Now, since the control fluid inlet pipe 7 is connected to the drain pipe, it is a great advantage for the outlet 17 to be isolated from the high-pressure source as this prevents the latter from being connected to the drain pipe.

Figure 3:
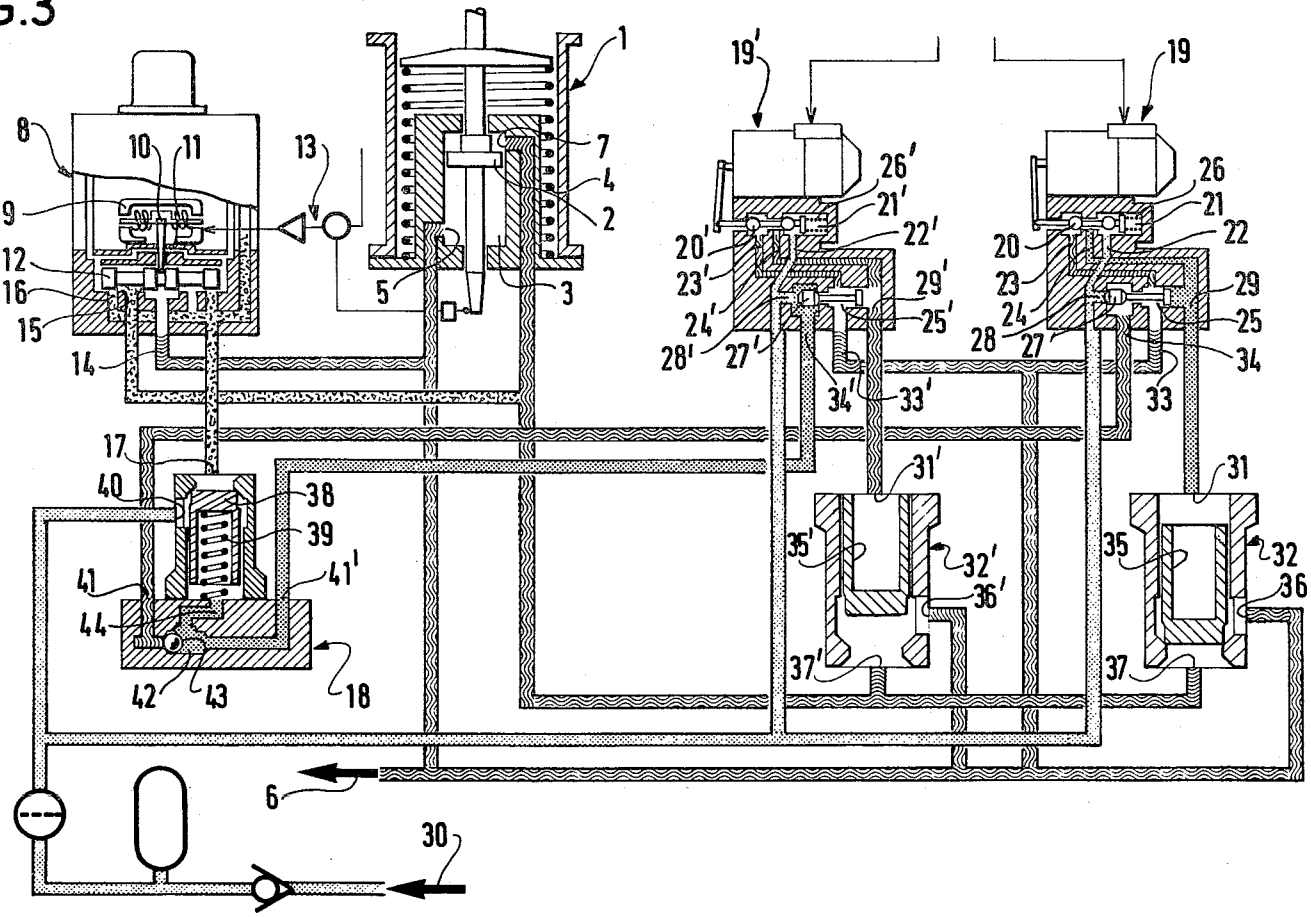
FIG. 3 is a schematic diagram which illustrates a regulation system in accordance with the invention during testing for proper operation.

FIG. 3 illustrates the regulation system in accordance with the invention when tests are made for proper operation. With the turbine operating and the regulation system in the state shown in FIG. 1, one of the electrically-operated valves, e.g. the valve 19', is released, the inlet 31' of the valve 32' is connected to the drain pipe and the piston of the valve 32' is pushed onto its seat, this connecting the inlet 37' to the drain pipe.

The control fluid inlet pipe 7 of the servomotor is therefore connected to the drain pipe and the piston is pushed by the spring 4 and completely closes the inlet units.

The outlet 34' of the electrically-operated valve 19' is connected to the high-pressure source, while the outlet 34 of the valve 19 is still connected to the drain pipe.

Therefore the inlet 41' of the valve 18 receives high-pressure fluid while the inlet 41 is connected to the drain pipe. The high-pressure fluid in the chamber 42 pushes the ball 43 against the inlet 41', thereby isolating the high-pressure fluid from the drain pipe.

The pipe 44 therefore receives high-pressure fluid and the piston 40 is therefore pushed onto its seat by the spring 39, the thrust of high fluid pressure coming from the pipe 44 and from the inlet 40 cancel each other.

The outlet 17 of the valve 18 is therefore isolated from the inlet 40 connected to the high-pressure fluid source. Therefore the control fluid inlet pipe 7 of the servomotor 1 which is connected firstly to the drain pipe via the valve 32' and secondly to the outlet 17 of the valve 18 via the servovalve 8 is isolated from the high-pressure fluid source. Therefore, due to the regulation system in accordance with the invention, tests for proper operation can be carried out without connecting the high-pressure fluid source to the drain pipe during these tests.

In the case where the high-pressure fluid source is no longer operating properly, the inlets 31 and 31' of the valves 32 and 32' no longer receive fluid with sufficient pressure and the pistons of the valves 32 and 32' are pushed onto their seats, this connecting the inlets 37 and 37' to the drain pipe. The control fluid inlet pipe 7 of the servomotor is then connected to the drain pipe.

Further, the spring 39 then pushes the piston 40 onto its seat, closing the isolation valve which prevents the high-pressure fluid source from being connected to the drain pipe.

I claim:

1. A regulation system for a steam turbine, said system including:

a servomotor 1 comprising firstly, a piston 2 slidable within a chamber 3, one end of said chamber being connected to a drain pipe 6 and the other end being connected to a fluid inlet 7 which controls the piston 2, and secondly a spring 4 tending to move the piston 2 away from the chamber end connected to the drain pipe 6;

a regulation circuit 13 for comparing a steam admission signal and a signal from the servomotor 1 which is a function of the position of the piston 2 and which delivers an error signal;

a servo valve 8 comprising: firstly a control inlet 16 connected to a pipe connected to a high-pressure fluid source 30, a control outlet 15 connected to the control fluid inlet 7 of the servomotor 1 and an outlet 14 connected to the drain pipe 6, and secondly a torque motor 9 and a slide valve 12 whose position is controlled by said torque motor 9 which receives the servomotor error signal, said slide valve 12 coupling the control outlet 15 with the drain pipe 6 when the error signal corresponds to excessive steam admission, or coupling the control outlet 15 with the control inlet 16 when it corresponds to insufficient steam admission;

two electrically operated valves 19, 19', each including means for receiving a signal which operates them in the case of accident, each electrically operated valve having an inlet 28, 28' connected to the high-pressure fluid source 30, a first outlet 33, 33' connected to the drain pipe 6 and a second outlet 29, 29' connected to a safety valve 32, 32', the second outlet 29, 29' communicating with the inlet 28, 28' when the electrically operated valve 19, 19' is operated and with the first outlet 33, 33' when the electro-valve 19, 19' is released;

each safety valve 32, 32' comprising: firstly, an outlet 36, 36' connected to the drain pipe 6, an inlet 31, 31' connected to the second outlet 29, 29' of the associated electrically operated valve 19, 19' and a second inlet 37, 37' connected to the control fluid inlet 7 of the servomotor 1, and secondly, a moving piston 35, 35' movable to two positions: a first position when high-pressure fluid is applied to the inlet 31, 31' and a second position when the inlet 31, 31' is connected to the drain-pipe 6, the second inlet 37, 37' being connected to the drain-pipe 6 when the piston 35, 35' is in the second position and being isolated from the drain-pipe 6 when the piston 35, 35' is in the first position, the improvement wherein:

each electrically operated valve 19, 19' has a third outlet 34, 34' and means 18 for connecting said third outlet 34, 34' to the drain-pipe 6 when the electrically operated valve 19, 19' is operated and for connecting said third outlet 34, 34' to the high-pressure fluid source 30 when the electrically operated valve 19, 19' is released and wherein the pipe connected to the inlet 16 of the servovalve 8 is connected to the high-pressure fluid source 30 via an isolation valve 18 which comprises a spring biased piston 38: and firstly, a first inlet 40 connected to the high-pressure fluid source 30 and an outlet 17 connected to said pipe as well as two control inlets 41, 41' which are connected to the third outlets 34, 34' of both of the electrically operated valves 19, 19' and which, when at least one of the electrically operated valves 19, 19' receives high-pressure fluid, assists a spring 39 to push said piston 38 into a blocking position for blocking communication between the isolation valve first inlet 40 and the outlet 17, said isolation valve piston 38 being returned to the other position by the high-pressure fluid applied by the source 30 to said isolation valve first inlet 40, when the two isolation valve control inlets 41, 41' are connected to the drain-pipe 6, which connects said first inlet 40 to the outlet 17 of said isolation valve 18.

* * * * *